US010005170B1

(12) United States Patent
Benedict et al.

(10) Patent No.: US 10,005,170 B1
(45) Date of Patent: Jun. 26, 2018

(54) METHODS OF CLEANING CMP POLISHING PADS

(71) Applicant: Rohm and Haas Electronic Materials CMP Holdings, Inc., Newark, DE (US)

(72) Inventors: Charles J. Benedict, Townsend, DE (US); Aaron E. Lorin, Bel Air, MD (US); Ryan Bortner, Philadelphia, PA (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 0 days. days.

(21) Appl. No.: 15/386,941

(22) Filed: Dec. 21, 2016

(51) Int. Cl.

| | |
|---|---|
| ***B24B 53/017*** | (2012.01) |
| ***B24B 37/04*** | (2012.01) |
| ***B08B 1/00*** | (2006.01) |
| ***B08B 1/02*** | (2006.01) |
| ***B08B 5/02*** | (2006.01) |
| ***B08B 7/04*** | (2006.01) |
| ***B08B 5/04*** | (2006.01) |

(52) U.S. Cl.
CPC ..... *B24B 53/017* (2013.01); *B08B 1/002* (2013.01); *B08B 1/02* (2013.01); *B08B 5/023* (2013.01); *B08B 5/043* (2013.01); *B08B 7/04* (2013.01); *B24B 37/042* (2013.01)

(58) Field of Classification Search
None
See application file for complete search history.

(56) References Cited

U.S. PATENT DOCUMENTS

| | | | | |
|---|---|---|---|---|
| 6,244,944 | B1 * | 6/2001 | Elledge | B08B 1/007 451/296 |
| 6,626,743 | B1 * | 9/2003 | Boyd | B24B 21/04 451/138 |
| 7,258,600 | B1 | 8/2007 | Benner | |
| 7,575,503 | B2 | 8/2009 | Benner | |
| 7,901,267 | B1 | 3/2011 | Benner | |
| 2002/0090896 | A1 | 7/2002 | Li et al. | |
| 2008/0032609 | A1 * | 2/2008 | Benedict | B24B 53/017 451/56 |
| 2013/0111678 | A1 | 5/2013 | Chen et al. | |
| 2013/0185884 | A1 | 7/2013 | Ko et al. | |
| 2014/0014136 | A1 | 1/2014 | Lin et al. | |
| 2015/0140818 | A1 | 5/2015 | Lee et al. | |
| 2015/0314417 | A1 | 11/2015 | Sun et al. | |
| 2016/0016283 | A1 | 1/2016 | Butterfield et al. | |

* cited by examiner

*Primary Examiner* — Nicole Blan
(74) *Attorney, Agent, or Firm* — Andrew Merriam

(57) ABSTRACT

The present invention provides methods for cleaning the surface of CMP polishing pads comprising blowing a stream or curtain of forced air or gas from a source onto the surface of a CMP polishing pad substrate at a pressure of from 170 kPa (24.66 psig) to 600 kPa (87 psig), towards a vacuum source, the forced air or gas blowing at an angle of from 6 to 15° from a vertical plane which lies normal to the surface of the substrate, traverses the entire width of the surface of the substrate, and passes through the source of the forced air or gas, while, at the same time conveying along a horizontal plane the CMP polishing pad so that the entire surface of the CMP polishing pad surface is exposed to the forced air or gas at least one time; and, vacuuming the surface of the CMP polishing pad at a point on the surface which is downstream from a point at which the stream curtain of forced air or gas contacts the surface of the CMP polishing pad.

10 Claims, 1 Drawing Sheet

METHODS OF CLEANING CMP POLISHING PADS

The present invention relates to methods for cleaning CMP polishing pads comprising blowing a curtain of forced air or gas from a source, such as an air bar, onto the surface of a CMP polishing pad substrate conveyed to pass through the curtain at a pressure of from 276 kPa (40 psi) to 600 kPa (87 psi) towards a vacuum source, the forced air or gas blowing at an angle of from 6 to 15° from a vertical plane which lies normal to the surface of the substrate and passes through the source of the forced air or gas.

In the manufacture of polishing pads for use in chemical mechanical planarization, molding and curing of a foamed or porous polymer, such as a polyurethane, generally will be followed by demolding and then cutting and shaping, for example, by grinding, routing or embossing a final surface design, such as grooves, into the top surface of the polishing pad or skiving the cured polymer in a direction parallel to the top surface of the mold to form a layer having desired thickness. These methods invariably create finely divided debris and loose particles on and in the polishing pad surface. The debris and particles become trapped in the pores of the CMP polishing pad. Accordingly, when the CMP polishing pads are in use, those debris and particles may cause defects in substrates polished with the CMP polishing pad, such as one or more layers of a semiconductor, thereby ruining those substrates. Such pad particles and debris can be removed, for example, by pre-conditioning the pads by abrasive conditioning in a wet process to break in the pad. This pre-conditioning process may remove debris and particles; however, this process is time consuming and is desirably minimized.

U.S. patent publication no. US 2008/0032609 A1, to Benedict, discloses an apparatus and method of using for reducing contaminants from a chemical mechanical polishing pad. The apparatus comprises a rotating vacuum platen for holding the pad, and a traversing arm equipped along its length with a contaminant collection nozzle which has both an air blast nozzle and, surrounding that nozzle, an annular vacuum. In the method of use, a vertically disposed CMP polishing pad held on the platen is rotated while the traversing arm moves between the peripheral edge and the center axis of the pad. The method and apparatus are useful in cleaning out the grooves or recessed areas of CMP polishing pads; however, the method and apparatus fail to remove the finely divided debris and particles located on and in the surface of the CMP polishing pad.

The present inventors have endeavored to solve the problem of providing CMP polishing pads having surfaces, including the visible pores within those surfaces, so that the pads are free of particles and other loose debris prior to use and with little or no pre-conditioning of the pads.

STATEMENT OF THE INVENTION

1. In accordance with the present invention, methods for cleaning the surface of CMP polishing pads comprise: Blowing, preferably, continuously until the surface of the CMP polishing pad is clean, a stream or curtain of forced air or gas from a source onto the surface of a CMP polishing pad substrate at a pressure of from 170 kPa (24.66 psig) to 600 kPa (87 psig), or, preferably, from 276 kPa (40 psig) to 500 kPa (72.52 psig), towards a vacuum source, the forced air or gas blowing at an angle of from 6 to 15°, or, preferably, from 8 to 12.5° from a vertical plane which lies normal to the surface of the substrate, traverses the entire width of the surface of the substrate, and passes through the source of the forced air or gas, while, at the same time: Conveying along a horizontal plane the CMP polishing pad substrate horizontally disposed on a flat platen so that the entire surface of the CMP polishing pad surface is exposed to the forced air or gas at least one time, preferably, twice; and, vacuuming the surface of the CMP polishing pad at a point on the surface which is downstream from a point at which the stream curtain of forced air or gas contacts the surface of the CMP polishing pad; and, optionally, brushing the surface of the CMP polishing pad at a point downstream of the point at which the CMP polishing pad is vacuumed.

2. The methods of the present invention in accordance with item 1, above, wherein the source of forced air or gas is located 30 mm or less, or, preferably, 20 mm or less, from the surface of the substrate as it is conveyed through the source of the forced air or gas, and wherein the stream or curtain of forced air or gas comprises a curtain that traverses the entire width of the surface of the CMP polishing pad substrate as the substrate is conveyed through the curtain or stream of forced air or gas.

3. The methods of the present invention in accordance with any one of items 1 or 2, above, wherein the source of the forced air or gas is a linear air or gas source, such as an air bar, or an air knife.

4. The methods of the present invention in accordance with any one of items 1, 2 or 3, above, wherein the conveying of the CMP polishing pad substrate along a horizontal plane comprises moving the CMP polishing pad disposed on a flat platen along a track or conveyor so that the entire surface of the CMP polishing pad substrate is exposed to the forced air or gas at least one time, preferably, twice in a back and forth fashion, during the blowing of the stream or curtain of forced air or gas.

5. The methods of the present invention in accordance with any one of items 1, 2, 3 or 4, above, wherein the flat platen comprises a vacuum platen to hold the CMP polishing pad in place.

6. The methods of the present invention in accordance with any one of items 1, 2, 3, 4 or 5, above, wherein the vacuuming comprises applying vacuum from a vacuum source, preferably, a vacuum hood, disposed parallel to the curtain of forced air or gas which traverses the entire width of the surface of the CMP polishing pad substrate and located less than 30 mm or, preferably, less than 20 mm from the substrate surface as it is conveyed past the vacuum source.

7. The methods of the present invention in accordance with any one of items 1, 2, 3, 4, 5, or 6, above, wherein the vacuuming comprises applying vacuum continuously during the blowing of the stream of forced air or gas.

8. The methods of the present invention in accordance with any one of items 1, 2, 3, 4, 5, 6, or 7, above, the method further comprising brushing the surface of the CMP polishing pad at a point downstream of the point at which the CMP polishing pad is vacuumed, while at the same time blowing the stream or curtain of forced air or gas onto the substrate and vacuuming, wherein the brushing comprises continuously contacting a brush element, such as a brush element comprising a row of brush bristles, with the surface of the CMP polishing pad during the conveying, the blowing and the vacuuming.

9. The methods of the present invention in accordance with item 8, above, wherein the brush element traverses the entire width of the surface of the CMP polishing pad substrate, is disposed parallel to each of the curtain of forced air or gas and the vacuum source, and contacts the CMP polishing pad substrate downstream of the vacuum source.

10. The methods of the present invention in accordance with any one of items 8 or 9, above, wherein the brush comprises a continuous brush element traversing the entire width of the surface of the CMP polishing pad substrate, for example, with no breaks in the brush element along its width.

11. The methods of the present invention in accordance with any one of items 1, 2, 3, 4, 5, 6, 7, 8, 9 or 10, above, the methods further comprising removing static charge from the CMP polishing pad substrate, such as by exposing the CMP polishing pad substrate to a static dissipation bar disposed a distance of less than 20 mm or, preferably, less than 10 mm from the surface of CMP polishing pad and acts on the CMP polishing pad substrate downstream from the brush element.

12. The methods of the present invention in accordance with item 11, above, wherein the removing static charge comprises exposing the CMP polishing pad substrate to a static dissipation bar that traverses the entire width of the surface of the CMP polishing pad substrate and is disposed parallel to each of the curtain of forced air or gas, the vacuum source and the brush element.

13. The methods of the present invention in accordance with any one of items 1, 2, 3, 4, 5, 6, 7, 8, 9, 10, 11 or 12, above, wherein in the conveying along a horizontal plane, the CMP polishing pad substrate is disposed surface side up or surface side down, and, further wherein, when the CMP polishing pad substrate is disposed surface side down all of the blowing of forced air or gas, the vacuuming source, the brushing, and the optional static dissipation base, are directed up to the CMP polishing pad substrate so that the brush element contacts the surface of the CMP polishing pad substrate and each of the source of forced air or gas, the vacuum source, and the optional static dissipation bar is disposed a distance of less than 20 mm or, preferably, less than 10 mm below the surface of the CMP polishing pad substrate.

14. The methods of the present invention in accordance with any one of items 1 to 13 above, wherein during the conveying of the CMP polishing pad substrate, the flat platen does not rotate, vibrate or shake and the brush remains static (unmoving) during the conveying.

15. The methods of the present invention in accordance with any one of items 1 to 14, above, wherein the conveying of the flat platen moves the flat bed platen at rate of from 0.1 to 2 m/min, or, preferably, from 0.4 to 1.3 m/min.

Unless otherwise indicated, conditions of temperature and pressure are ambient temperature and standard pressure. All ranges recited are inclusive and combinable.

Unless otherwise indicated, any term containing parentheses refers, alternatively, to the whole term as if no parentheses were present and the term without them, and combinations of each alternative. Thus, the term "(poly) isocyanate" refers to isocyanate, polyisocyanate, or mixtures thereof.

All ranges are inclusive and combinable. For example, the term "a range of 50 to 3000 cPs, or 100 or more cPs" would include each of 50 to 100 cPs, 50 to 3000 cPs and 100 to 3000 cPs.

As used herein, the term "ASTM" refers to publications of ASTM International, West Conshohocken, Pa.

As used herein, the term "compressibility" refers to a percent of compressibility as determined by the ASTM F36-99 procedure ("Standard Test Method for Compressibility and Recovery of Gasket Materials", 1999), and dividing the difference of its thickness initially ($T_{f1}$) and after compression ($T_{f2}$) by a force f2 by its initial thickness ($T_{f1}$), or $(T_{f1}-T_{f2})/T_{f1}$. In the present invention, f1 is 5.964 kPa (0.865 psi) and f2 is 40.817 kPa (5.920 psi).

As used herein, the term "weight density" refers to the result determined by the dividing the weight of a given material or pad by its volume, as determined by multiplying its thickness by its total surface area, such as, for a round pad, $\pi \times r^2$, where r is the radius of the round pad.

As used herein, the term "wt. %" stands for weight percent.

Figure 1:
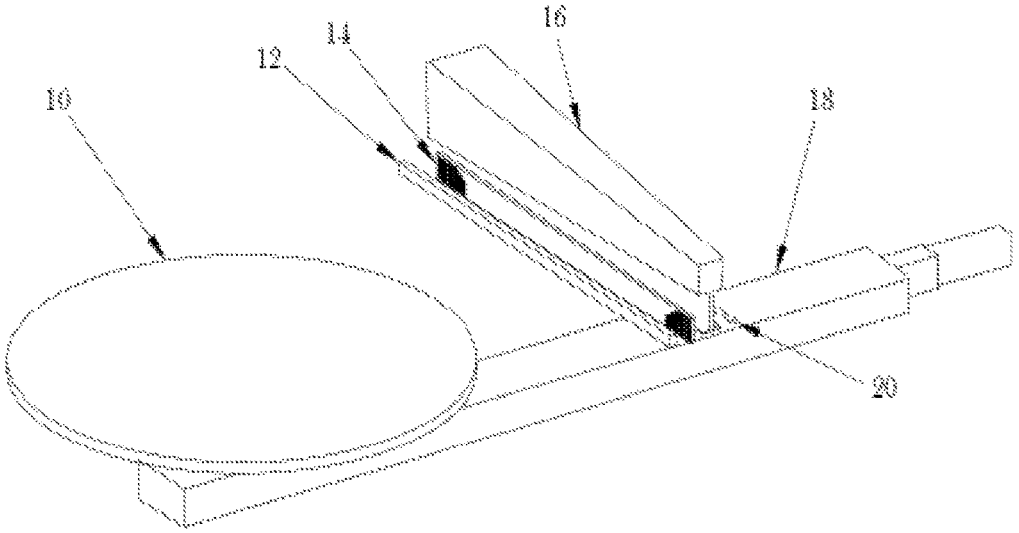
FIG. 1 depicts an apparatus for use in accordance with the methods of the present invention with the CMP polishing layer or pad and shows an example of a flat bed platen or flat platen, the track or conveyor and the forced air, vacuum, brush element and static dissipation bar useful in the methods of the present invention.

In accordance with the present invention, methods of cleaning CMP polishing layers or pads enable the removal of contaminants from the surface of the CMP polishing layers or pads after they are manufactured and before they are conditioned for polishing. The present inventors have surprisingly found that blowing a stream or curtain of forced air or gas at a high pressure of at least 276 kPa or, preferably, at least 360 kPa from a short distance of 30 mm or less onto the surface of a CMP polishing layer or pad and against a brush element that acts as a dam to trap debris and particles which have been freed from the pad surface will remove as much as eighty (80%) of such debris and particles found on such pads after manufacture. A vacuum source disposed between the stream or curtain of forced air or gas and the brush element effectively removes the trapped debris and particles. Further, treating the CMP polishing layer substrate with a static dissipation element prior to blowing the forced air or gas onto the substrate enables such a high debris and particles removal rate.

The methods of the present invention are scalable to fit CMP polishing layers of various sizes, as the size of any of the stream or curtain of forced air or gas, the vacuum source, the brush element and/or the static dissipation bar can be varied. In accordance with the methods of the present invention, the flat platen should be larger than the CMP polishing layer or, preferably, of a size having a radius that is equal to or within 10 cm longer than the radius of the CMP polishing layer. The methods thus are scalable to treat CMP polishing layers having a radius of from 100 mm to 610 mm.

The methods of the present invention are conducted in a dry environment and can be conducted in an air tight or climate controlled chamber wherein no additional contaminants are present aside from the debris and particles located in or on the surface of the CMP polishing layer.

The methods of the present invention enable the provision of CMP polishing layers or pads useful in back end CMP polishing. Suitable pads have a compressibility, as defined above, of from 10 to 30%.

Suitable CMP polishing layers for use in accordance with the methods of the present invention preferably comprise a porous polymer or filler containing porous polymer material such as a porous polyurethane. As used herein, the term "porous polymer" refers to polymers having pores within them; as used herein, the term "poromeric" is refers to a polymer matrix having pores within the polymer.

The methods of the present invention can be carried out on any pad, including those made from soft polymers, such as polyurethanes and find particular use in treating soft pads having a compressibility of from 10 to 30%. Pores can be provided by spaces in the pad polymer matrix.

The methods of the present invention can be performed on single layer or solo pads, as well as on stacked pads having a subpad layer.

As shown in FIG. 1, the methods of the present invention are carried out on the surface of a flat platen (10) with vacuum ports, not shown. In FIG. 1, the flat platen (10) carries the CMP polishing layer substrate under, moving from left to right, a static dissipation bar (12), a brush element (14), a vacuum hood (16) and an air bar (20). The various items are arranged so that air bar (20) blows forced air at an slight angle down onto a CMP polishing layer substrate, with the slight angle leaning toward vacuum hood (16) and brush element (14). In FIG. 1, as flat platen (10) carrying a CMP polishing layer substrate is conveyed along the track (18), the static dissipation bar acts on the substrate before it reaches any forced air or gas curtain.

Figure 2:
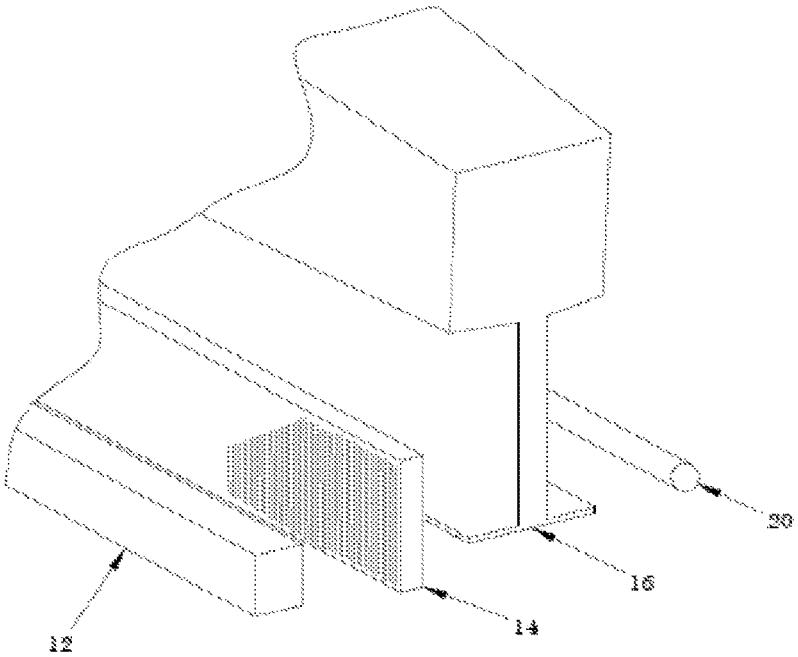
FIG. 2 depicts a cut away view of a forced air bar, vacuum hood, brush element and static dissipation bar useful in the methods of the present invention.

As shown in FIG. 2, in the methods of the present invention the CMP polishing layer substrate is acted upon, in order, as it moves from left to right, a static dissipation bar (12), a brush element (14), a vacuum hood (16) and an air bar (20).

In the apparatus of the present invention, each of the source of forced air or gas, the vacuum source, the brush element and the static dissipation bar are mounted on the same bracket and can be raised and lowered in unison, such as via a mechanical actuator such as a ball screw, or an electric servo motor mechanically linked to a gear that raises and lowers the bracket. Preferably, the brush element has an additional finely threaded ball screw so that it can be independently raised and lowered at least a total distance of 30 mm.

Preferably, in the methods of the present invention the CMP polishing layer substrate is conveyed past all of the static dissipation bar, the brush element, the vacuum source and the source of forced air or gas once so that the whole surface is treated. In FIG. 1, this conveying consists of moving the CMP polishing layer substrate on a platen from left to right so that the whole substrate passes under the source of forced air or gas.

More preferably, in the methods of the present invention, the CMP polishing layer substrate is conveyed past all of the static dissipation bar, the brush element, the vacuum source and the source of forced air or gas twice so that each of two times the whole surface is treated. In FIG. 1, this conveying consists of moving the CMP polishing layer substrate on a platen from left to right all the way past the source of forced air or gas, and then moving it from right to left back to its starting point.

A suitable apparatus useful in the methods of the present invention is a Neutro-Vac™ tool (Simco-Ion, Hatfield, Pa.), which can come in a customized width.

In the methods of the present invention, the composition of forced air or gas is not limited except that it must be inert. Suitable gases include air, carbon dioxide or helium.

The stream or curtain of forced air or gas in accordance with the present invention can comprise a curtain flowing from an air bar or other linear source of air having a plurality of forced air or gas outlet opens disposed all along its length. Preferably, the stream or curtain of forced air or gas flows from a source wherein at each point along the source forced air or gas travels a path that has one and the same length before reaching the substrate. Such a source of forced air or gas can be any that are disposed parallel to the surface of the CMP polishing layer substrate and that run at least the width of the CMP polishing layer or pad.

The stream or curtain of forced air or gas could fan out from a single point to form a fan as wide as the CMP polishing layer substrate; however, such a fan will provide less force in proportion to the distance of the substrate from the fan source. The flat bed platen in the apparatus of the present invention contains a plurality of small holes, for example, from 0.5 to 5 mm in diameter, through the platen which are connected to a vacuum. The holes can be arranged in any suitable manner to hold the CMP polishing layer substrate in place during grinding, such as, for example, along a series of spokes extending outward from the center point of the flat platen or in a series of concentric rings.

The vacuum source used in the methods of the present invention is connected to a vacuum pump, whereby debris and particles can be removed from the CMP polishing layer substrate.

The vacuum from the vacuum source can be provided at a pressure of from 0.01 bar (1 kPa) to 0.5 bar (50.5 kPa) or, preferably, from 0.03 bar (3 kPa) to 0.2 bar (20.2 kPa).

The vacuum provided by the flat platen can be provided at the same pressure as the vacuum from the vacuum source.

The brush element used in the methods of the present invention can be any inert plastic, for example, polyamide, hard rubber or natural, for example, horse hair brush material that effectively blocks the flow of debris and particles loosened by the stream or curtain of forced air or gas. In the methods of the present invention, the brush element is at least in contact with the surface of the CMP polishing layer substrate.

The static dissipation bar used in the methods of the present invention can comprise an electrically powered source of ionized particles or charges, such as tungsten emitters, directed at the CMP polishing layer substrate. The static dissipation bar is disposed a distance of less than 20 mm or, preferably, less than 10 mm from the surface of CMP polishing pad.

The static dissipation bar used in the methods of the present invention may touch the CMP polishing layer substrate surface in the methods of the present invention. In such a case, the static dissipation bar can comprise an antistatic material, such as, for example, conductive positively charged polymers like polyaniline or polyethylenimine; conductive materials, such as carbon black; antistatic material coated materials, such as indium tin oxide coated ceramics or inorganic oxide materials. The antistatic material can be in fibrous form, in a sheet form, or it can be a composite of particles molded in the form of a bar or strip.

EXAMPLES

In the following examples, unless otherwise stated, all units of pressure are standard pressure (~101 kPa) and all units of temperature are room temperature (21-23° C.).

The following test method was used in the Examples that follow:

Particle Count:

Particles were counted using monochromatic lighting in a 7.62 cm×7.62 cm (3"×3") area of the given pad substrate. The area with the highest and lowest particle count was chosen and an average value was calculated before cleaning the pad and after cleaning the pad to determine % of particles removed.

Example 1

Experiments were conducted using 50.8 cm (20") diameter, and 1.524 mm (60 mil) thick Politex™ porous polyurethane soft pad having a weight density of 0.286 g/cm$^3$ and a compressibility of 15% (The Dow Chemical Co., Midland, Mich. (Dow)). In the methods of the Examples, a static bar was used to neutralize the charge of the material and aid with dislodging particles from the pad surface. An air knife was used to blow compressed air onto the surface of the CMP polishing layer substrate to dislodge particles. The air knife was set at an angle of about 6° to a vertical plane which lies normal to the surface of the substrate and passing through the source of the forced air in the air knife. For Comparative pads 1-4, 9-12 and 17-20, the (compressed) air pressure was set at 48.26 kPA (7 psi); and, for inventive pads 5-8, 13-16, and 21-26, the air pressure was set at 413.69 kPA (60 psi). No brush was used. The pads were conveyed so that they passed twice, once forth and once back under the forced air and vacuum sources at a rate of about 1.1 m/min.

A vacuum source was set to draw debris and particles from the indicated pad substrates at an average velocity of 19.8 m/s (3902 fpm). The vacuum source was set at a distance from the flat platen that varied from 0.508 to 1.016 cm (0.2" to 0.4"). The results are shown in Table 1 below.

Example 1b

Experiments were conducted using 50.8 cm (20") diameter, and 1.524 mm (60 Mil) thick Politex™ porous polyurethane soft pad having a weight density of 0.286 g/cm$^3$ and a compressibility of 15% (The Dow Chemical Co., Midland, Mich. (Dow)). In the methods of the Examples, a static bar was used to neutralize the charge of the material and aid with dislodging particles from the pad surface. An air knife was used to blow compressed air at a force of, for pads 1 (comparative), 4 (comparative), 5, 8, 9, 10, 11, and 12 172.37 kPa (25 psig), and, for Comparative pads 2, 3, 6, and 7 34.37 kPa (5 psig) onto the surface of the CMP polishing layer substrate to dislodge particles.

The air knife was set at a given angle of from 5 to 30° from a vertical plane which lies normal to the surface of the substrate and passing through the source of the forced air in the air knife; for Comparative pads 1-2, the air knife was set at an angle of about 25° from the vertical plane; for Comparative pads 3-4, the air knife was set at an angle of about 20° from the vertical plane; for pads 5-6, the air knife was set at an angle of about 10° from the vertical plane; and, for pads 7-12 an angle of 6° from the vertical plane. Dislodged particles were captured using a vacuum source set to draw debris and particles from the indicated pad substrates at an average velocity of 19.8 m/s (3902 fpm). No brush was used. The pads were conveyed so that they passed twice, once forth and once back under the forced air and vacuum sources at a rate of about 1.1 m/min.

A vacuum source was set to draw debris and particles from the indicated pad substrates at an average velocity of 19.8 m/s (3902 fpm). The vacuum nozzle distance from the flat platen was 9.5 mm. The results are shown in Table 1 b, below.

TABLE 1

| Vacuum Nozzle Distance Trial | | | | | | | | |
|---|---|---|---|---|---|---|---|---|
| Pad # | Initial High Particle Count | Initial Low Particle Count | Initial Average Particle Count | Vacuum Nozzle Dist (mm) | After Cleaning High Particle Count | After Cleaning Low Particle Count | After Cleaning Average Particle Count | Removal % |
| Vacuum Nozzle Distance Test | | | | | | | | |
| *1 | 75 | 17 | 46 | 5.08 | 33 | 3 | 18 | 61% |
| *2 | 43 | 5 | 24 | 5.08 | 38 | 4 | 21 | 13% |
| *3 | 72 | 16 | 44 | 5.08 | 61 | 10 | 35.5 | 19% |
| *4 | 69 | 12 | 40.5 | 5.08 | 53 | 6 | 29.5 | 27% |
| 5 | 89 | 4 | 46.5 | 5.08 | 31 | 3 | 17 | 63% |
| 6 | 60 | 11 | 35.5 | 5.08 | 9 | 1 | 5 | 86% |
| 7 | 82 | 5 | 43.5 | 5.08 | 15 | 0 | 7.5 | 83% |
| 8 | 119 | 11 | 65 | 5.08 | 15 | 1 | 8 | 88% |
| | | | | Average | | | | 55% |
| *9 | 104 | 15 | 59.5 | 6.35 | 82 | 7 | 44.5 | 25% |
| *10 | 36 | 10 | 23 | 6.35 | 45 | 7 | 26 | −13% |
| *11 | 72 | 18 | 45 | 6.35 | 49 | 9 | 29 | 36% |
| *12 | 65 | 6 | 35.5 | 6.35 | 56 | 4 | 30 | 15% |
| 13 | 95 | 10 | 52.5 | 6.35 | 16 | 2 | 9 | 83% |
| 14 | 167 | 22 | 94.5 | 6.35 | 31 | 3 | 17 | 82% |
| 15 | 38 | 11 | 24.5 | 6.35 | 8 | 1 | 4.5 | 82% |
| 16 | 58 | 4 | 31 | 6.35 | 21 | 0 | 10.5 | 66% |
| | | | | Average | | | | 52% |
| *17 | 108 | 11 | 59.5 | 10.16 | 68 | 10 | 39 | 34% |
| *18 | 148 | 21 | 84.5 | 10.16 | 104 | 19 | 61.5 | 27% |
| *19 | 137 | 40 | 88.5 | 10.16 | 103 | 25 | 64 | 28% |
| *20 | 242 | 34 | 138 | 10.16 | 149 | 34 | 91.5 | 34% |
| 21 | 43 | 5 | 24 | 10.16 | 28 | 9 | 18.5 | 23% |
| 22 | 123 | 18 | 70.5 | 10.16 | 17 | 3 | 10 | 86% |
| 23 | 107 | 11 | 59 | 10.16 | 28 | 1 | 14.5 | 75% |
| 24 | 42 | 12 | 27 | 10.16 | 11 | 3 | 7 | 74% |
| 25 | 37 | 5 | 21 | 6.35 | 15 | 1 | 8 | 62% |
| 26 | 92 | 9 | 50.5 | 6.35 | 14 | 2 | 8 | 84% |
| | | | | Average | | | | 48% |

*Denotes Comparative Example.

As shown in Table 1, above the pads cleaned using a forced air pressure within the inventive range gave dramatically better particle removal. The only exception was in Example 21 where the pad itself had a very low number of particles or impurities to begin with. Further, the absence of a brush impaired control of the methods so the results varied more than with the brush. Compare Table 2, below.

TABLE 1b

Air Knife Angle Testing

| Pad # | Initial High Particle Count | Initial Low Particle Count | Initial Average Particle Count | Vacuum Nozzle Dist (mm) | After Cleaning High Particle Count | After Cleaning Low Particle Count | After Cleaning Average Particle Count | Removal % |
|---|---|---|---|---|---|---|---|---|
| *1 | 57 | 6 | 31.5 | 9.5 | 43 | 5 | 24 | 24% |
| *2 | 109 | 10 | 59.5 | 9.5 | 145 | 7 | 76 | −28% |
| *3 | 121 | 8 | 64.5 | 9.5 | 143 | 5 | 74 | −15% |
| *4 | 175 | 8 | 91.5 | 9.5 | 82 | 1 | 41.5 | 55% |
| 5 | 72 | 14 | 43 | 9.5 | 28 | 3 | 15.5 | 64% |
| *6 | 77 | 27 | 52 | 9.5 | 39 | 8 | 23.5 | 55% |
| *7 | 127 | 9 | 68 | 9.5 | 124 | 6 | 65 | 4% |
| 8 | 38 | 5 | 21.5 | 9.5 | 13 | 0 | 6.5 | 70% |
| 9 | 95 | 15 | 55 | 9.5 | 42 | 4 | 23 | 58% |
| 10 | 51 | 10 | 30.5 | 9.5 | 56 | 2 | 29 | 5% |
| 11 | 153 | 7 | 80 | 9.5 | 69 | 4 | 36.5 | 54% |
| 12 | 99 | 19 | 59 | 9.5 | 62 | 8 | 35 | 41% |

As shown in Table 1 b, above, in the absence of a brush element, the pad cleaning methods of the present invention are not nearly as effective as they are with the brush. Compare Table 2, below. This is surprising because the brush itself only traps particles for vacuum removal and does not itself remove the particles from the pad. Inventive Example 10 shows that the methods of the present invention lack preferred consistency without use of a brush; although the pad of Example 10 had a very low initial average count. Compare Examples 8, 9, 11 and 12.

Example 2

Example 1 was repeated except that a brush was installed adjacent to the vacuum nozzle downstream from the air knife which was used to blow compressed air at a pressure of 413.7 kPA (60 psig) onto the surface of the CMP polishing layer substrate to dislodge particles. The air knife was set at an angle of about 10° from a vertical plane which lies normal to the surface of the substrate and passing through the source of the forced air in the air knife. The brush bristles lightly contacted the pad. The pads were conveyed so that they passed twice, once forth and once back under the forced air and vacuum sources at a rate of about 1.1 m/min. The brush dislodged particles from the surface of the pad and directed them toward the vacuum nozzle.

TABLE 2

Brush Installed Testing

| Pad # | Initial High Particle Count | Initial Low Particle Count | Initial Average Particle Count | Vacuum Nozzle Dist (mm) | After Cleaning High Particle Count | After Cleaning Low Particle Count | After Cleaning Average Particle Count | Removal % |
|---|---|---|---|---|---|---|---|---|
| 1-1 | 43 | 4 | 23.5 | 9.5 | 9 | 0 | 4.5 | 81% |
| 2-1 | 137 | 13 | 75 | 9.5 | 21 | 0 | 10.5 | 86% |
| 3-1 | 53 | 11 | 32 | 9.5 | 19 | 0 | 9.5 | 70% |
| 4-1 | 77 | 12 | 44.5 | 9.5 | 14 | 0 | 7 | 84% |
| 1-2 | 203 | 9 | 106 | 9.5 | 31 | 0 | 15.5 | 85% |
| 2-2 | 174 | 15 | 94.5 | 9.5 | 32 | 2 | 17 | 82% |
| 3-2 | 30 | 5 | 17.5 | 9.5 | 7 | 0 | 3.5 | 80% |
| 4-2 | 88 | 16 | 52 | 9.5 | 12 | 0 | 6 | 88% |
| 5-2 | 54 | 5 | 29.5 | 9.5 | 7 | 0 | 3.5 | 88% |

TABLE 2-continued

| Brush Installed Testing | | | | | | | | |
|---|---|---|---|---|---|---|---|---|
| Pad # | Initial High Particle Count | Initial Low Particle Count | Initial Average Particle Count | Vacuum Nozzle Dist (mm) | After Cleaning High Particle Count | After Cleaning Low Particle Count | After Cleaning Average Particle Count | Removal % |
| 6-2 | 207 | 17 | 112 | 9.5 | 56 | 0 | 28 | 75% |
| 7-2 | 152 | 4 | 78 | 9.5 | 25 | 0 | 12.5 | 84% |
| 8-2 | 201 | 11 | 106 | 9.5 | 53 | 0 | 26.5 | 75% |
| 9-2 | 253 | 10 | 131.5 | 9.5 | 31 | 0 | 15.5 | 88% |
| 10-2 | 39 | 4 | 21.5 | 9.5 | 6 | 0 | 3 | 86% |
| | | | | Average | | | | 82% |

As shown in Table 2, above, in methods of the present invention wherein the air knife was set at an inventive angle to a vertical plane which lies normal to the surface of the substrate and passing through the source of air, a static brush element was used in the inventive manner, and the forced air was blown at inventive pressures, the average amount of particles removed was 82%. This was a consistently excellent result.

We claim:

1. A method for cleaning a surface of CMP polishing pads comprising:

blowing blowing a stream or curtain of forced air or gas from a source onto the surface of a CMP polishing pad substrate at a pressure of from 170 kPa (24.66 psig) to 600 kPa (87 psig), towards a vacuum source, the forced air or gas blowing at an angle of from 6 to 15° from a vertical plane which lies normal to the surface of the CMP polishing pad substrate, traverses the entire width of the surface of the CMP polishing pad substrate, and passes through the source of the forced air or gas while, at the same time conveying along a horizontal plane the CMP polishing pad substrate horizontally disposed on a flat platen so that the entire surface of the CMP polishing pad substrate is exposed to the forced air or gas at least one time; and, vacuuming the surface of the CMP polishing pad at a point on the surface which is downstream from a point at which the stream or curtain of forced air or gas contacts the surface of the CMP polishing pad substrate.

2. The method as claimed in claim 1, wherein the blowing forced air or gas comprises blowing at an angle of from 8 to 12.5° from a vertical plane which lies normal to the surface of the CMP polishing pad substrate, traverses the entire width of the surface of the CMP polishing pad substrate and passes through the source of the forced air or gas.

3. The method as claimed in claim 1, wherein the source of forced air or gas is located 20 mm or less, from the surface of the CMP polishing pad substrate as it is conveyed through the source of the forced air or gas, and wherein the stream or curtain of forced air or gas comprises a curtain that traverses the entire width of the surface of the CMP polishing pad substrate as the CMP polishing pad substrate is conveyed through the curtain or stream of forced air or gas.

4. The method as claimed in claim 1, wherein the conveying of the CMP polishing pad substrate along the horizontal plane comprises moving the CMP polishing pad substrate disposed on the flat platen along a track or conveyor so that the entire surface of the CMP polishing pad substrate is exposed to the forced air or gas at least twice, in a back and forth fashion, during the blowing of the stream or curtain of forced air or gas.

5. The method as claimed in claim 1, wherein the flat platen comprises a vacuum platen to hold the CMP polishing pad substrate in place.

6. The method as claimed in claim 1, wherein the vacuuming comprises applying vacuum from a vacuum source disposed parallel to the curtain of forced air or gas which traverses the entire width of the surface of the CMP polishing pad substrate and located less than 20 mm from the CMP polishing pad substrate surface as it is conveyed past the vacuum source.

7. The method as claimed in claim 1, wherein the vacuuming comprises applying vacuum continuously during the blowing of the stream of forced air or gas.

8. The method as claimed in claim 1, further comprising brushing the surface of the CMP polishing pad substrate at a point downstream of the point at which the CMP polishing pad substrate is vacuumed, while at the same time blowing the stream or curtain of forced air or gas onto the CMP polishing pad substrate and vacuuming, wherein the brushing comprises continuously contacting a brush element with the surface of the CMP polishing pad substrate during the conveying, the vacuuming and the blowing.

9. The method as claimed in claim 8, wherein the brush element traverses the entire width of the surface of the CMP polishing pad substrate, is disposed parallel to each of the curtain of forced air or gas and the vacuum source, and contacts the CMP polishing pad substrate downstream of the vacuum source.

10. The method as claimed in claim 1, wherein in the conveying along the horizontal plane, the CMP polishing pad substrate is disposed surface side up or surface side down, and, further wherein, when the CMP polishing pad substrate is disposed surface side down all of the blowing of forced air or gas, the vacuuming source, the brushing are directed up to the CMP polishing pad substrate so that the brush element contacts the surface of the CMP polishing pad substrate and each of the source of forced air or gas, and the vacuum source, is disposed a distance of less than 20 mm below the surface of the CMP polishing pad substrate.

* * * * *